US011613922B2

(12) United States Patent
Rupp et al.

(10) Patent No.: US 11,613,922 B2
(45) Date of Patent: Mar. 28, 2023

(54) GUIDE SYSTEM FOR GUIDING A DOOR LEAF

(71) Applicant: Julius Blum GmbH, Hoechst (AT)

(72) Inventors: Matthias Rupp, Hohenweiler (AT); Christian Hauer, Hoerbranz (AT); Hermann Haemmerle, Lustenau (AT); Ingo Gasser, Hoechst (AT); Franz Kohlweiss, Hard (AT)

(73) Assignee: JULIUS BLUM GMBH, Hoechst (AT)

( * ) Notice: Subject to any disclaimer, the term of this patent is extended or adjusted under 35 U.S.C. 154(b) by 777 days.

(21) Appl. No.: 16/578,580

(22) Filed: Sep. 23, 2019

(65) Prior Publication Data

US 2020/0018107 A1 Jan. 16, 2020

Related U.S. Application Data

(63) Continuation of application No. PCT/AT2018/000038, filed on May 4, 2018.

(30) Foreign Application Priority Data

May 11, 2017 (AT) ..... A 50388/2017

(51) Int. Cl.
*E05D 15/58* (2006.01)
*E05D 15/26* (2006.01)
(Continued)

(52) U.S. Cl.
CPC ..... *E05D 15/58* (2013.01); *E05D 15/264* (2013.01); *E05F 1/16* (2013.01); *E05F 3/221* (2013.01)

(58) Field of Classification Search
CPC ..... E05D 15/58; E05D 15/264; E05D 15/26; E05F 1/16; E05F 1/08; E05F 3/221;
(Continued)

(56) References Cited

U.S. PATENT DOCUMENTS 5,131,449 A * 7/1992 Winn ..... E05D 15/264 160/214
8,109,582 B2 2/2012 Dubach
(Continued)

FOREIGN PATENT DOCUMENTS

AT 502 417 3/2007
CN 101257819 9/2008
(Continued)

OTHER PUBLICATIONS

International Search Report dated Aug. 3, 2018 in International (PCT) Application No. PCT/AT2018/000038.
(Continued)

*Primary Examiner* — William L Miller
(74) *Attorney, Agent, or Firm* — Wenderoth, Lind & Ponack, L.L.P.

(57) ABSTRACT

A guide system includes a first guide rail for guiding a door wing, a second guide rail for guiding the door wing. A carrier can move the door wing relative to the second guide rail in a direction extending transversely to the longitudinal direction of the first guide rail. A drive device has a force storage member, and the carrier can be at least partially ejected by the drive device from the retracted position of the carrier by a force of the force storage member. The drive device includes a coupling portion and a control curve, and the coupling portion and the control curve are decoupled over a large part of the movement of the carrier between the extended position and the retracted position. The carrier can be retracted into the retracted position starting from a position immediately before the retracted position when the coupling portion couples with the control curve.

17 Claims, 9 Drawing Sheets

(51) Int. Cl.
*E05F 1/16* (2006.01)
*E05F 3/22* (2006.01)

(58) Field of Classification Search
CPC ..... E05F 3/14; E06B 3/5045; Y10T 16/593; Y10T 16/5995; Y10T 16/61; E05Y 2900/212
USPC ..... 160/192; 16/72, 76, 82
See application file for complete search history.

(56) References Cited

U.S. PATENT DOCUMENTS

| | | | | |
|---|---|---|---|---|
| 9,068,386 | B2 | 6/2015 | Ishii et al. | |
| 9,375,083 | B2 * | 6/2016 | Haemmerle | A47B 88/463 |
| 9,380,873 | B2 | 7/2016 | Zimmer et al. | |
| 9,386,850 | B2 * | 7/2016 | Dubach | A47B 88/463 |
| 9,894,996 | B1 * | 2/2018 | Grela | E05D 15/48 |
| 10,227,806 | B2 * | 3/2019 | Gabl | E05F 1/16 |
| 10,316,565 | B2 * | 6/2019 | Gabl | E05D 15/58 |
| 10,344,515 | B2 | 7/2019 | Ishii et al. | |
| 10,400,493 | B2 * | 9/2019 | Gabl | E05D 15/264 |
| 10,550,606 | B2 * | 2/2020 | Hammerer | E05C 19/022 |
| 10,753,133 | B2 * | 8/2020 | Kohlweiss | E05F 1/1041 |
| 10,876,340 | B2 * | 12/2020 | Rupp | E06B 3/482 |
| 11,008,791 | B2 * | 5/2021 | Rupp | E05F 1/08 |
| 11,136,804 | B2 * | 10/2021 | Rupp | E05F 5/003 |
| 11,274,482 | B2 * | 3/2022 | Rupp | E05D 15/58 |
| 2008/0191592 | A1 | 8/2008 | Dubach | |
| 2011/0154817 | A1 | 6/2011 | Zimmer et al. | |
| 2015/0008811 | A1 | 1/2015 | Ishii et al. | |
| 2016/0123060 | A1 | 5/2016 | Choi et al. | |
| 2017/0241178 | A1 | 8/2017 | Gabl | |
| 2017/0260789 | A1 | 9/2017 | Gabl | |
| 2018/0058121 | A1 | 3/2018 | Ishii et al. | |
| 2018/0087305 | A1 * | 3/2018 | Dubach | E05F 1/1041 |
| 2018/0119470 | A1 * | 5/2018 | Kohlweiss | E05D 15/58 |
| 2019/0284859 | A1 * | 9/2019 | Rupp | E05F 3/20 |
| 2019/0301216 | A1 * | 10/2019 | Rupp | E05D 15/26 |
| 2019/0301218 | A1 * | 10/2019 | Rupp | E05F 1/08 |
| 2020/0040632 | A1 * | 2/2020 | Rupp | E05D 15/266 |
| 2021/0246700 | A1 * | 8/2021 | Hoffmann | E05D 15/264 |
| 2022/0056746 | A1 * | 2/2022 | Meusburger | E05D 15/58 |

FOREIGN PATENT DOCUMENTS

| | | |
|---|---|---|
| CN | 105569466 | 5/2016 |
| CN | 205840586 | 12/2016 |
| FR | 2821878 | 9/2002 |
| JP | 2011-522642 | 8/2011 |
| WO | 2013/114730 | 8/2013 |
| WO | 2016/081961 | 6/2016 |
| WO | 2016/081963 | 6/2016 |
| WO | 2016/147588 | 9/2016 |

OTHER PUBLICATIONS

English translation of Search Report dated Dec. 7, 2018 in Taiwanese Application No. 107114855.
Search Report dated Sep. 3, 2020 in corresponding Chinese Patent Application No. 201880026713.1.

* cited by examiner

GUIDE SYSTEM FOR GUIDING A DOOR LEAF

BACKGROUND OF THE INVENTION

The present invention relates to a guide system for guiding a movably supported door wing, the guide system comprising a first guide rail having a longitudinal direction for guiding the door wing, a second guide rail for guiding the door wing, the second guide rail extending transversely to the longitudinal direction of the first guide rail in a mounted condition. A carrier can move the door wing in the mounting condition relative to the second guide rail in a direction extending transversely to the longitudinal direction of the first guide rail between an extended and a retracted position. A drive device has a force storage member, and the carrier can be ejected by the drive device from the retracted position of the carrier at least over a region in a direction of the extended position of the carrier by a force of the force storage member. The drive device includes a coupling portion and a control curve.

The invention further concerns an arrangement comprising at least one door wing and a guide system of the type to be described. Moreover, the invention relates to an item of furniture comprising such a guide system or an arrangement of the aforementioned type.

WO 2016/081961 A1 discloses an item of furniture having a door wing, and the door wing can be moved from a first position, in which the furniture carcass is covered, into a second position in which the door wing can be countersunk in a lateral cavity of the furniture carcass. The door wing can be ejected by a mechanical drive device from the countersunk position within the cavity into a position outside the cavity. The drive device thereby includes a control curve extending over the depth of the cavity, and a control element in the form of a pressure roller pressurized by a force storage member is configured to run along the control curve. A drawback is the fact that the arrangement of the control curve depends on the width of the door wing and on the depth of the cavity. As a result, this includes an increased expenditure on material. Moreover, the pressure roller runs along the control curve over the entire depth of the cavity upon a retraction movement and upon an extension movement of the door wing. The movement of the door wing is decelerated due to the friction between the pressure roller and the control curve under the emission of unwanted noises. Moreover, for inserting the door wing into the retracted end position, an increased manual effort is required, because the pressure roller, at the end of the insertion movement, has to be moved over a relatively large distance onto an elevation of the control curve against the force of the force storage member, so that the force storage member can be again loaded in order for the door wing to be ejected.

US 2015/0008811 A1 discloses a guide system for two door wings being hingedly connected to one another, and the door wings can be moved along guide rails extending at a right angle to one another. The door wings can only be moved in a depth direction of the item of furniture when the door wings are aligned parallel to one another.

AT 502 417 A1 discloses a lockable ejection device for drawers, in which the ejection device can be unlocked by overpressing the drawer into a release position located behind the closed end position. After unlocking, the drawer can be ejected by a force of a spring into an open position. When the drawer is closed, the drawer rail of the drawer pull-pull out guide is coupled to a retraction device via coupling elements, so that the drawer can be retracted into the closed end position by a force storage member of the retraction device.

SUMMARY OF THE INVENTION

It is an object of the present invention to propose a guide system of the type mentioned in the introductory part, thereby avoiding at least one of the aforementioned drawbacks.

According to the invention, it is provided that the coupling portion and the control curve, over a large part of movement of the carrier between the extended position and the retracted position, are decoupled from one another, and the carrier, when the coupling portion couples with the control curve, can be retracted into the retracted position starting from a position lying immediately before the retracted position.

Accordingly, the coupling portion and the control curve, over a major part of the movement path of the carrier, are configured to be moved independently from one another and are only coupled to one another at the end of the insertion movement of the carrier in a direction of the retracted position, and the force storage member of the drive device is loaded by the cooperation of the coupling portion with the control curve and, subsequently, the carrier can be retracted into the retracted position by a force of the force storage member. In the retracted position of the carrier, the force storage member is at least partly loaded, so that the carrier can be again ejected by the stored energy of the force storage member from the retracted position in a direction of the extended position. This ejecting operation can be performed after an effected activation by a person, for example in such a way that the carrier is locked in the retracted position and can be unlocked by overpressing the carrier starting from the retracted position into an overpressing position lying behind the retracted position, whereupon the carrier can be ejected by a force of the force storage member.

Thereby, either:

- the coupling portion can be arranged on the carrier or can be configured to be entrained with the carrier, and the control curve can be arranged on the second guide rail or on a component fixed to the furniture carcass, or
- the coupling portion can be arranged on the second guide rail or on a component fixed to the furniture carcass, and the control curve can be arranged on the carrier or can be configured to be entrained with the carrier.

BRIEF DESCRIPTION OF THE DRAWINGS

Further details and advantages of the invention result from the embodiment shown in the drawing, in which.

DETAILED DESCRIPTION OF THE INVENTION

Figure 1A:
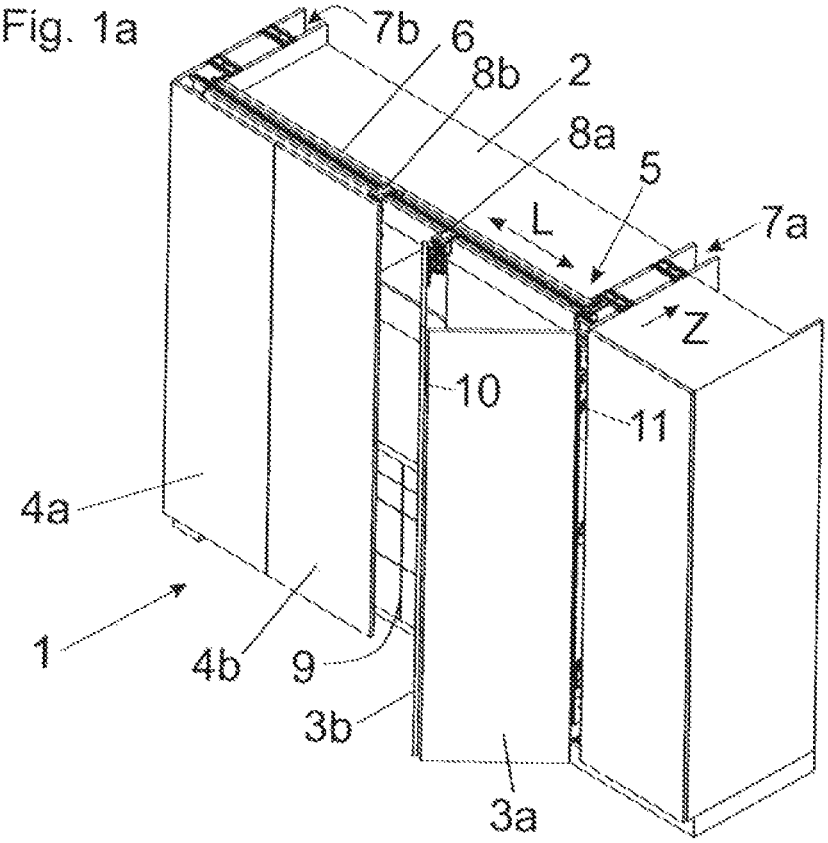
FIG. 1*a*, 1*b* are two perspective views of an item of furniture having door wings configured to be movably supported relative to a furniture carcass by a guide system.

FIG. 1*a* shows a perspective view of an item of furniture 1 having door wings 3*a*, 3*b* and 4*a*, 4*b* configured to be movably supported by a guide system 5 relative to a furniture carcass 2. The guide system 5 includes a first guide rail 6 having a longitudinal direction (L), and a second guide rail 11 extending transversely, preferably at a right angle, to the longitudinal direction (L) for guiding the door wings 3*a* and 3*b*. A guiding device 8*a* connected to the door wing 3*b* is provided, the guiding device 8*a* being configured to be moved along the first guide rail 6 and relative to the second guide rail 11. The first guide rail 6 and the second guide rail 11 can be configured as separate components and can adopt a same height position or a different height position relative to one another in the mounting condition. Alternatively, it is possible that the first guide rail 6, together with the second guide rail 11, can have a one-piece configuration.

Figure 1B:
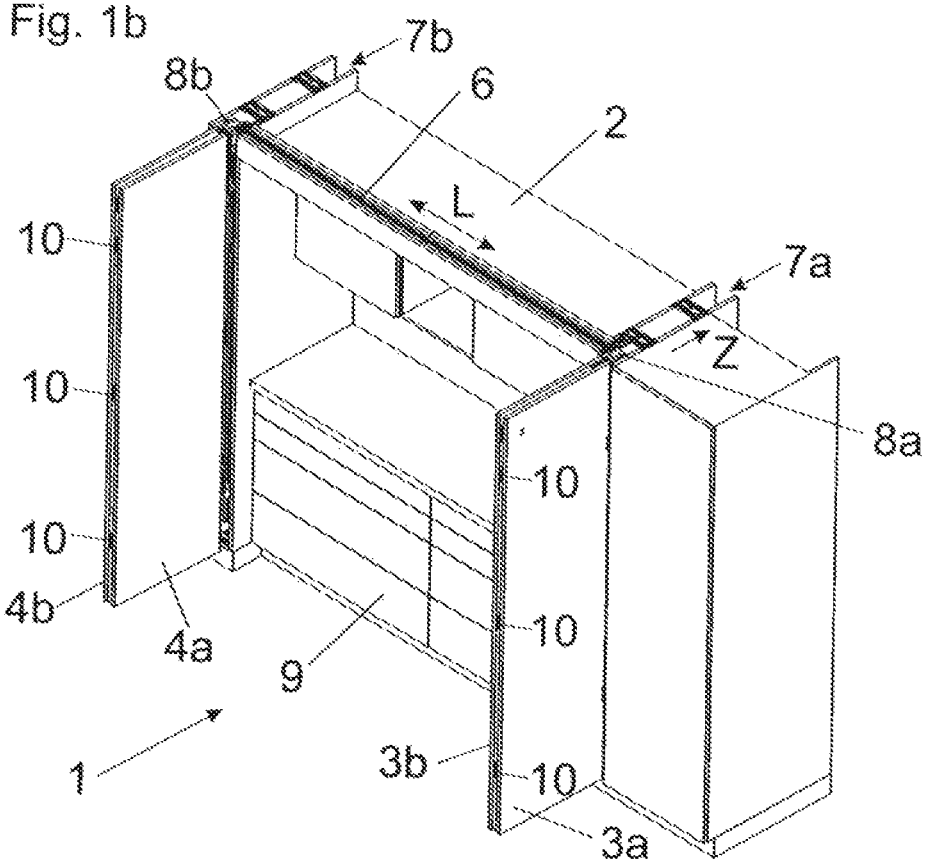

The door wings 3*a*, 3*b* can be inserted into a lateral cavity 7*a* when aligned in a parallel relationship to one another. By a second guiding device 8*b* connected to the door wing 4*b*, the two other door wings 4*a*, 4*b* can be moved relative to the first guide rail 6 and can be inserted into a second lateral cavity 7*b* when aligned in a parallel position to one another. Each of the door wings 3*a*, 3*b* and 4*a*, 4*b* are pivotally connected to one another by furniture hinges 10, so that each of the door wings 3*a*, 3*b* and 4*a*, 4*b* are hingedly connected to one another by a vertically extending axis. FIG. 1*b* shows the item of furniture 1, in which each of the door wings 3*a*, 3*b* and 4*a*, 4*b* are aligned parallel to one another and can be inserted in a direction (Z) into the lateral cavities 7*a*, 7*b*, the direction (Z) extending transversely to the longitudinal direction (L)

Figure 2:
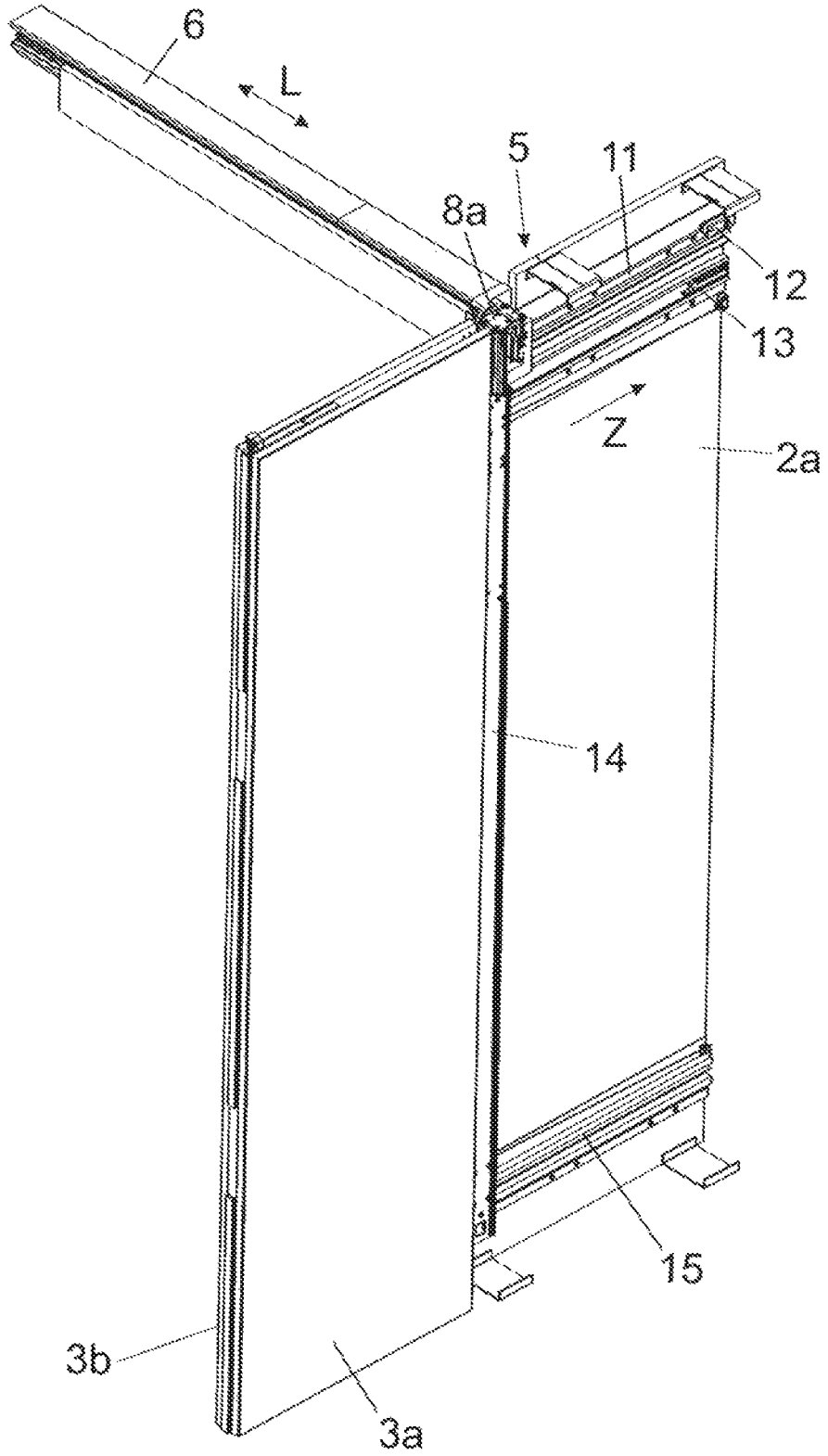
FIG. 2 is a perspective view of the door wings with the guide system.

FIG. 2 shows a perspective view of the door wings 3*a*, 3*b* configured to be moved along the first guide rail 6 by the guiding device 8*a* connected to the door wing 3*b*. The guiding device 8*a* is configured to be releasably coupled to a vertically extending carrier 14, so that the guiding device 8*a*, together with the door wings 3*a*, 3*b*, can be inserted in the direction (Z) extending transversely to the longitudinal direction (L) along the second guide rail 11. The carrier 14, in the mounted condition, can be moved into a transfer position in which the carrier 14 adjoins the first guide rail 6 in the longitudinal direction (L) such that the guiding device 8*a* can be transferred to and from between the first guide rail 6 and the carrier 14. The second guide rail 11 is fixed to a side wall 2*a* of the furniture carcass 2, and the second guide rail 11, in the rear end region, has a control curve 12 for releasably coupling to a coupling portion 21 (not shown here) of the carrier 14. The second guide rail 11 further includes a damping device 13, for example a linear damper having a piston-cylinder-unit, for dampening a movement of the carrier 14 in the direction (Z). The carrier 14 is thus movably supported relative to the second guide rail 11 between an extended and a retracted position, and the lower end region of the carrier 14 is guided relative to a further guide rail 15, for example by running wheels. A height of the carrier 14 can thereby extend over a major part of a height of the door wings 3*a*, 3*b*. The carrier 14 can be formed, for example, by an angled rail profile member.

Figure 3:
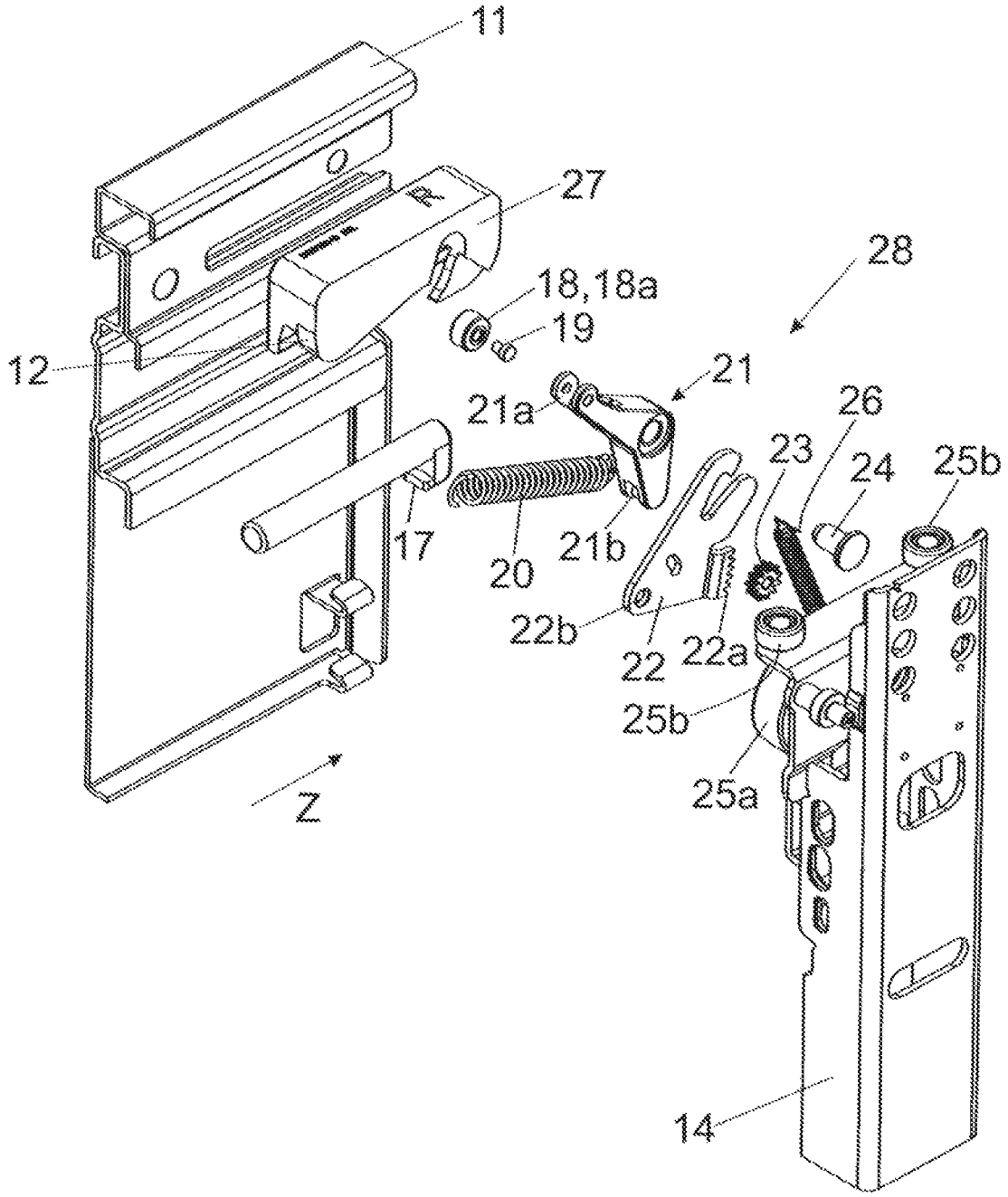
FIG. 3 shows the rear end region of the second guide rail with the drive device in an exploded view.

FIG. 3 shows the rear end region of the second guide rail 11 with the drive device 28 in an exploded view. The carrier 14 can be retracted by the drive device 28 at the end of the insertion movement by a force of a force storage member 20 into the retracted position relative to the second guide rail 11 in the direction (Z), and can be again ejected by a force of the same force storage member 20, after unlocking, from the retracted position in a direction opposite the direction (Z). A bearing portion 27 is to be fixed to the second guide rail 11, and a control curve 12 is formed or arranged on the bearing portion 27. The carrier 14 includes at least one running wheel 25*a* having a horizontal rotational axis and at least one running wheel 25*b* having a vertical rotational axis, and the running wheels 25*a* and 25*b* are configured to run along a running limb of the second guide rail 11. A coupling portion 21 is pivotally mounted about a pivoting axis 24 on the carrier 14, and the coupling portion 21, in the shown embodiment, is configured as a two-armed lever having two lever ends 21*a*, 21*b*. A pressure portion 18, preferably a pressure roller 18*a* configured to be rotated about the hinge axis 19, is arranged on a first lever end 21*a* of the coupling portion 21, and the pressure roller 18*a* can be displaced along the control curve 12 upon a movement of the carrier 14 in the direction (Z). By means of an abutment portion 17, the movement of the carrier 14 in the direction (Z) can be introduced into the damping device 13 (FIG. 2), so that the movement of the carrier 14 can be decelerated until reaching the retracted position. By means of a locking lever 22, the coupling portion 21 can be releasably locked in the retracted position, and the locking lever 22 is pre-stressed by a spring element 26 in a direction in which the coupling portion 21 can be released. The spring element 26 operates against a force of a timing element 29 (FIG. 4*b*), so that the locking between the locking lever 22 and the coupling portion 21 can only be released by a delaying force of the timing element 29 after a predetermined time period. This function serves for the purpose that the carrier 14, after the retracting process, is not again immediately ejected into an extended position by a force of the force storage member 20.

Figure 4A:
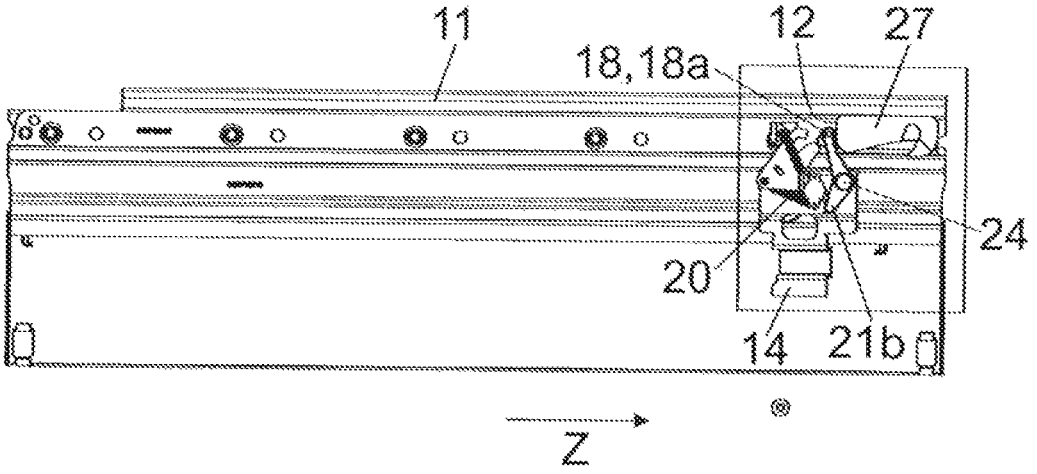
FIG. 4*a*, 4*b* shows the second guide rail in a side view and an enlarged detail view thereof.

FIG. 4*a* shows the second guide rail 11 in a side view, in which the bearing portion 27 with the control curve 12 is fixed to the rear end portion of the second guide rail 11. The carrier 14, for the sake of improved understanding, is partially hidden. The coupling portion 21 is pivotally arranged about a pivoting axis 24 on the carrier 14, and the coupling portion 21 and the control curve 12, over a large part of the movement of the carrier 14 between the extended position and the retracted position, are decoupled from one another and can only be coupled to one another at the end of the retracted position. This coupling will then be effected when the coupling portion 21, in the present case the pressure portion 18, abuts against the control curve 12 (FIG. 4*b*) upon a movement in the direction (Z).

Figure 4B:
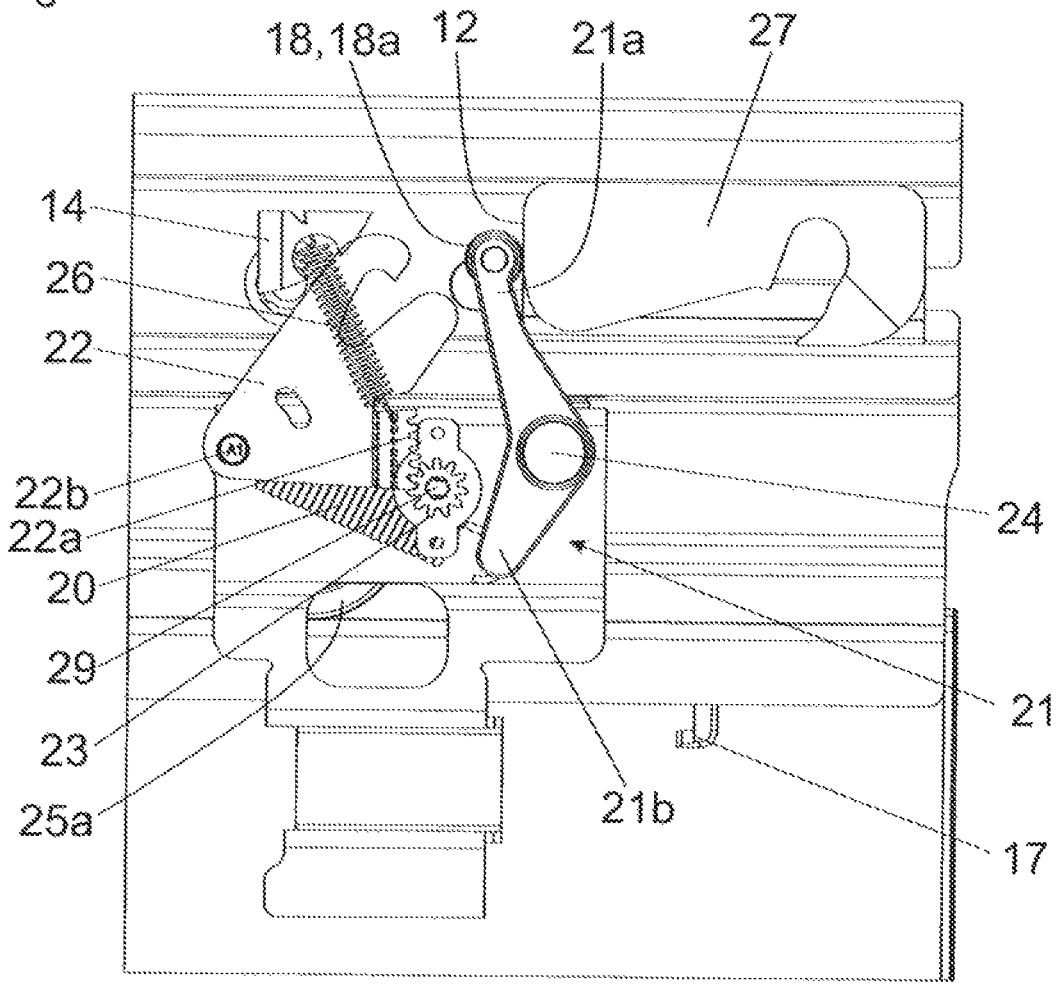

FIG. 4*b* shows the framed region of FIG. 4*a* in an enlarged view. The coupling portion 21 is pivotally mounted about the pivoting axis 24 and includes two lever arms 21*a* and 21*b*, and the pressure portion 18 in the form of the pressure roller 18*a* arranged on the first lever arm 21*a* abuts against the control curve 12 of the bearing portion 27. The force storage member 20 engages the second lever arm 21*b* of the coupling portion 21, and the force storage member 20, in the shown figure, is in a relaxed condition. The force storage member 20 can include one or also a plurality of helical spring(s). In the shown figure, the force storage member 20 is configured as a tension spring, so that the pressure portion 18, upon a continued movement of the carrier 14 in the direction (Z), can be pressed against the control curve 12 by a force of the force storage member 20. A timing element 29 is arranged on the partially depicted carrier 14, the timing element 29 being in the form of rotational damper. Preferably, the rotational damper is in the form of a fluid damper. The pinion 23 of the rotational damper cooperates with the tooth arrangement 22*a* of the locking lever 22.

Figure 5A:
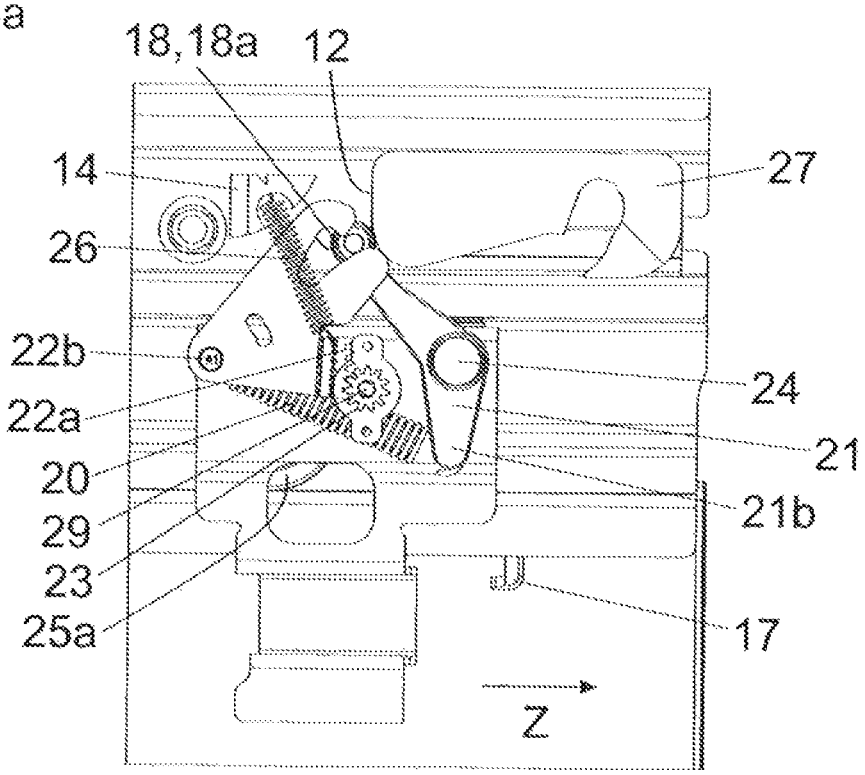
FIG. 5*a*, 5*b* show continued positions of the carrier in relation to FIGS. 4*a*, 4*b* in a direction of the retracted position.
Figure 5B:
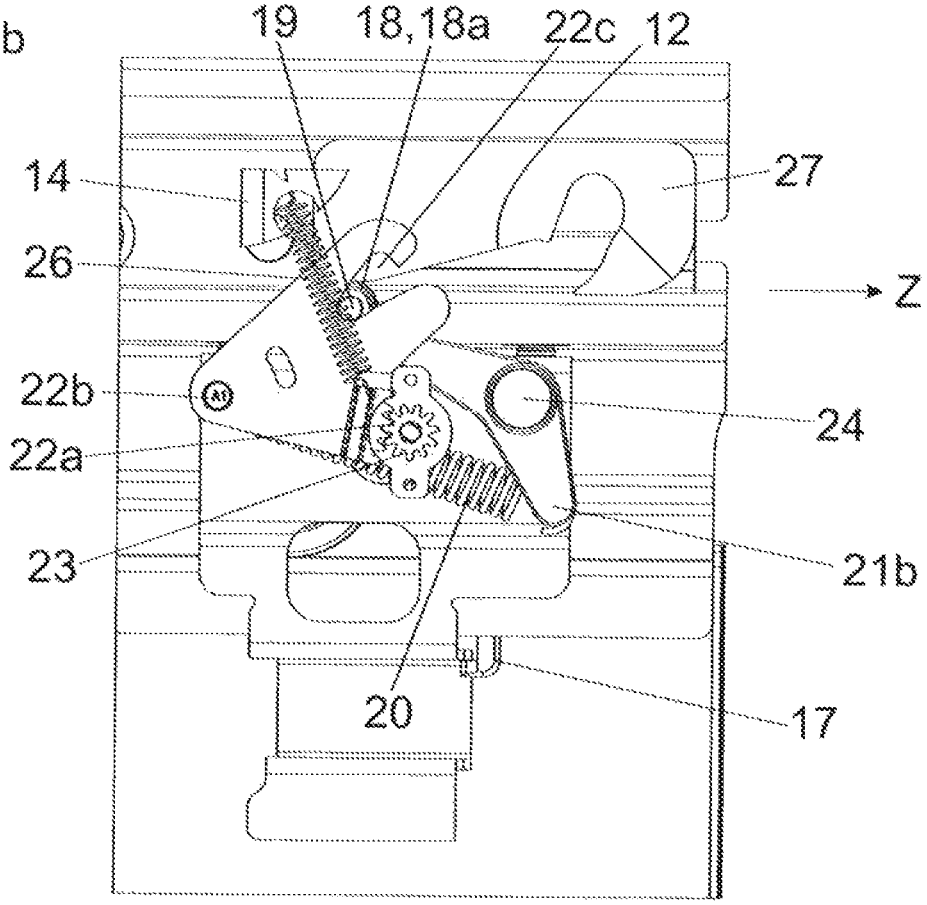

FIG. 5*a* shows a continued movement of the carrier 14, in relation to FIGS. 4*a*, 4*b*, in the direction (Z) of the retracted position. Upon a movement of the carrier 14 in the direction (Z), the pressure portion 18 is initially displaceable along a tensioning section of the control curve 12. The coupling portion 21 in the form of the two-armed lever is tilted in an anticlockwise direction, and the force storage member 20 in the form of the tension spring is tensioned. FIG. 5*b* shows a continued movement of the carrier 14 in the direction (Z), and the pressure portion 18 is located on the highest region of the control curve 12. As a result, the force storage member 20 is maximally tensioned.

Figure 6A:
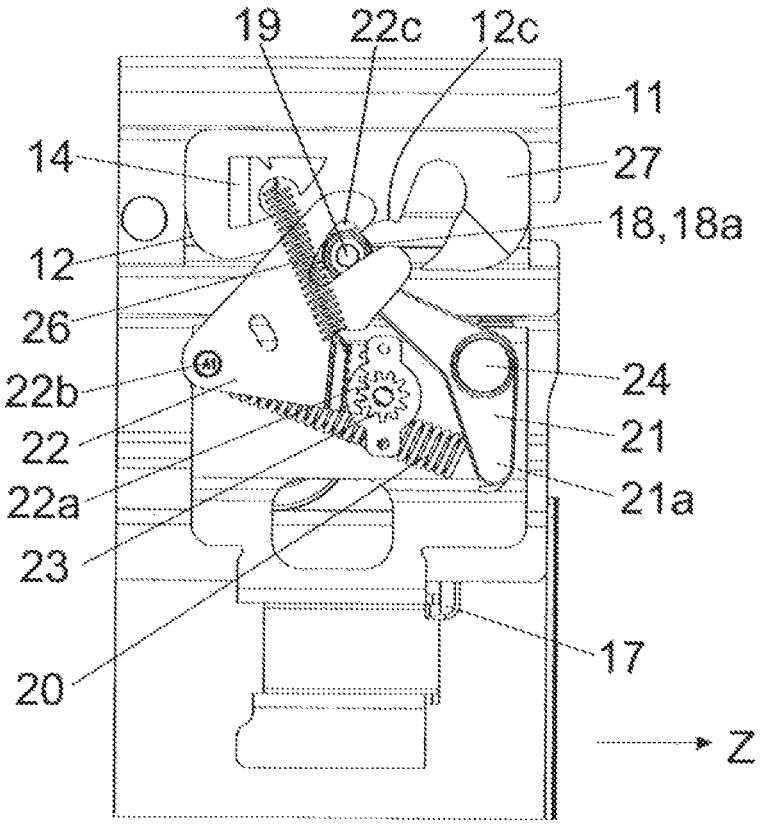
FIG. 6*a*, 6*b* show a further continued movement of the carrier in a direction of the retracted position, and the position of the carrier in the retracted position.

FIG. 6*a* shows a continued movement of the carrier 14 in the direction (Z) of the retracted position. The pressure portion 18, starting from the previous shown FIG. 5*b*, is now displaceable along a retraction section of the control curve 21, because the control curve 21, in this region, forms a reducing relative distance with respect to the pivoting axis 24 of the coupling portion 21. In this way, the force storage member 20 can relax, whereby the carrier 14 (and therewith the door wings 3*a*, 3*b*) can be retracted in the direction (Z) by a force of the relaxing force storage member 20. The hinge axis member 19, on which the pressure portion 18 in the form of the pressure roller 18*a* is arranged, is thereby moved into a recess 22*c* of the locking lever 22. Due to the entry of the hinge axis member 19 into the recess 22*c*, the locking lever 22 is pivoted about the pivoting axis 22*b* in a clockwise direction, and the tooth arrangement 22*a* of the locking lever 22 and the pinion 23 of the timing element 29 (rotational damper) are configured to run along one another, and the spring element 26 in the form of the tension spring 26 is tensioned. The carrier 14 thereby abuts against the abutment member 17, whereby a movement of the carrier 14 in the direction (Z) can be decelerated by the damping device 13 (FIG. 2) until reaching the retracted position.

Figure 6B:
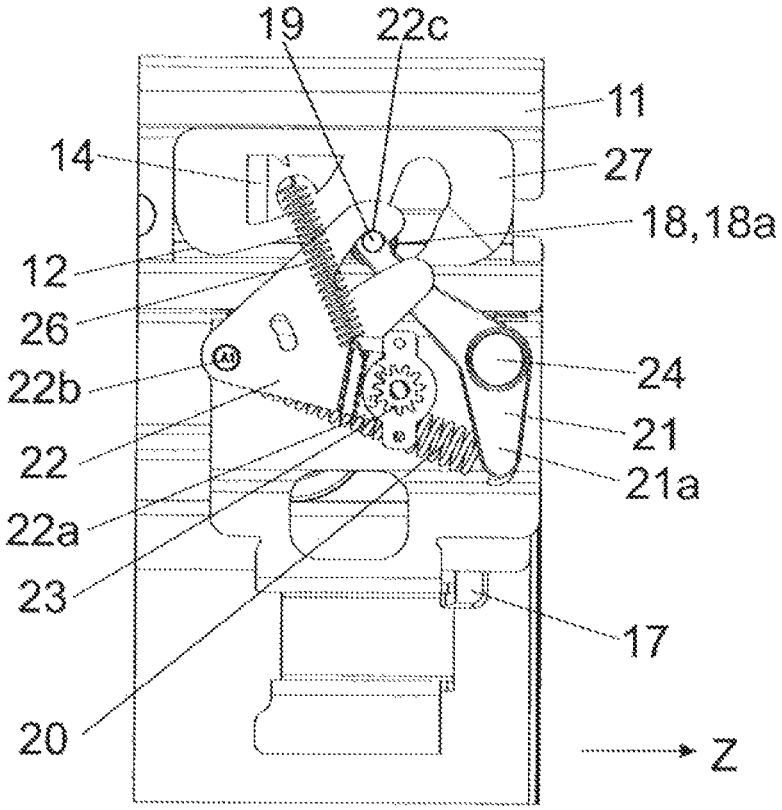

In FIG. 6*b*, the retracted position of the carrier 14 is shown. The pressure portion 18 in the form of the pressure roller 18*a* is locked to a locking section 12*c* (FIG. 6*a*), preferably to a recess, of the control curve 12, so that the carrier 14 is held with a predetermined force in the shown retracted position. The hinge axis member 19 of the pressure portion 18 is thereby releasably locked to the recess 22*c* of the locking lever 22. Both of the spring element 26 and the force storage member 20 are in a tensioned condition. A movement of the carrier 14 in the direction (Z) in the last retraction path has been decelerated by the damping device 13, and the abutment member 17—in a direct comparison with FIG. 6*a*—has been pushed in the direction (Z).

Figure 7A:
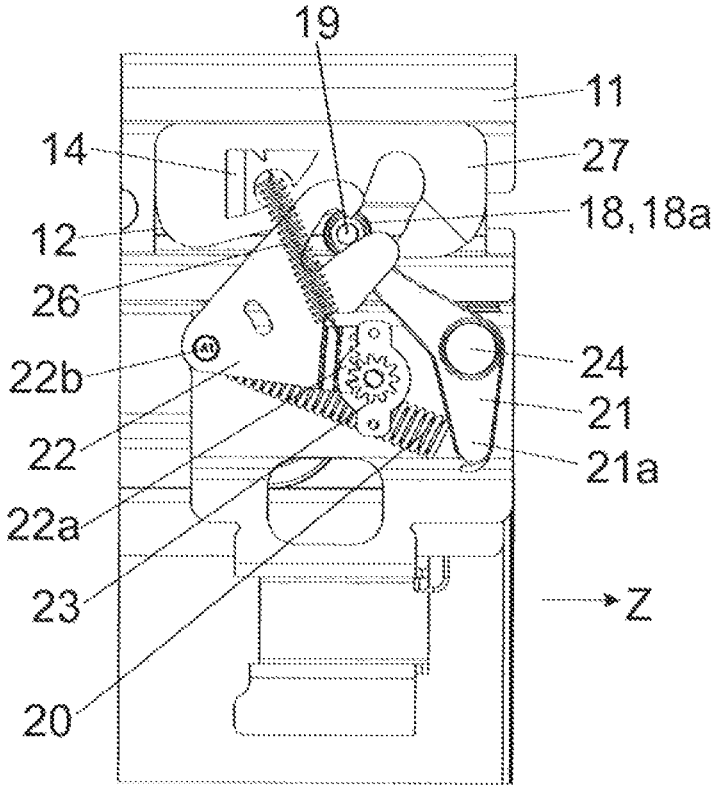
FIG. 7*a*, 7*b* show the unlocking of the carrier for moving the carrier in an ejection direction, and the overpressing position of the carrier.
Figure 7B:
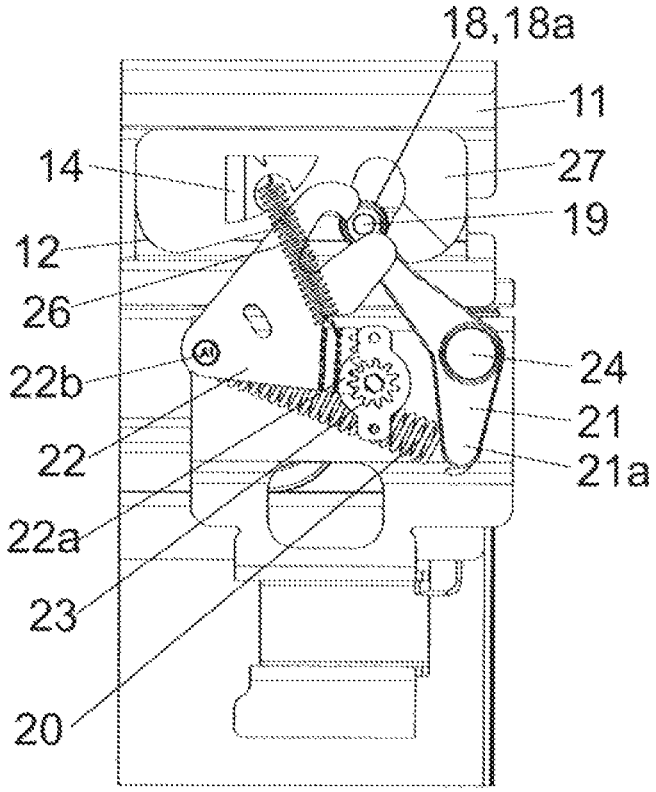

FIG. 7*a* shows the position of the carrier 14, after the locking between the locking lever 22 and the coupling portion 21 has been released by overpressing the carrier 14, starting from the retracted position, into an overpressing position lying behind the retracted position. Accordingly, the carrier 14 is moved into the overpressing position by manually applying a force, and the locking between the hinge axis member 19 and the recess 22*c* of the locking lever 22 can be released. The locking lever 22 is pivoted in the anticlockwise direction due to the release between the hinge axis 19 of the pressure portion 18 and the locking lever 22, and due to the force of the relaxing spring element 26. A movement of the locking lever 22 into the unlocking position is decelerated by the timing element 29 in the form of the rotational damper. The pinion 23 of the rotational damper is configured to run along the tooth arrangement 22*a* of the locking lever 22, so that a movement of the locking lever 22 is dampened in the anticlockwise direction (FIG. 7*b*). By the timing element 29 in the form of the rotational damper, it is namely prevented that the carrier 14 (and therewith the door wings 3*a*, 3*b*), when reaching the retracted position, is or are not immediately again ejected in a direction opposite the direction (Z).

Figure 8A:
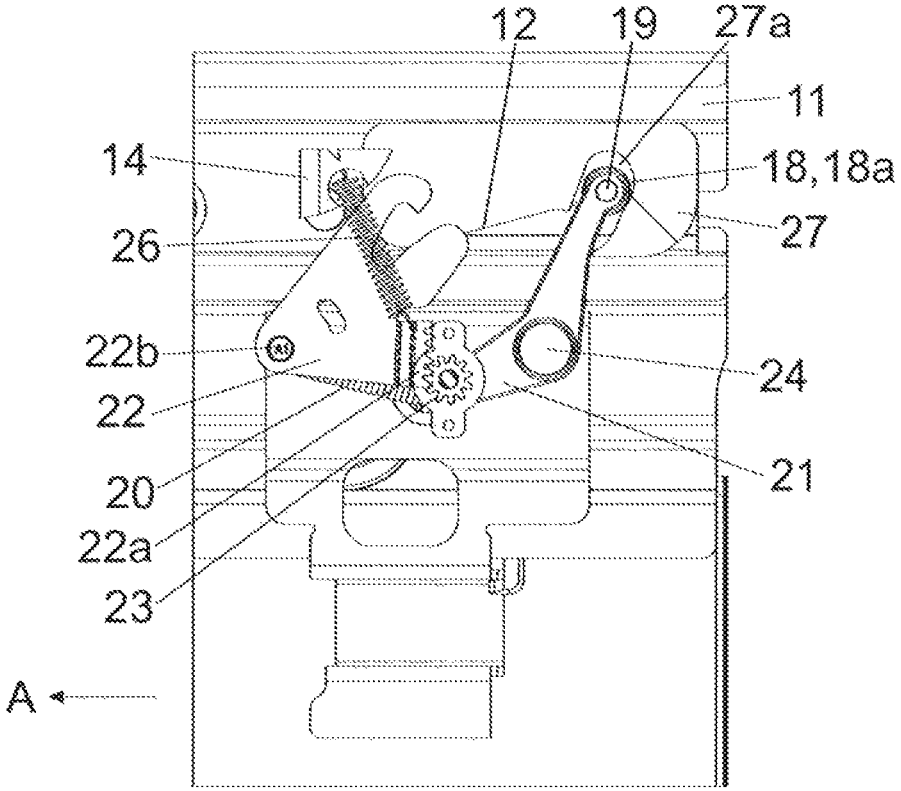
FIG. 8*a*, 8*b* show two different positions of the carrier in the ejection direction.
Figure 8B:
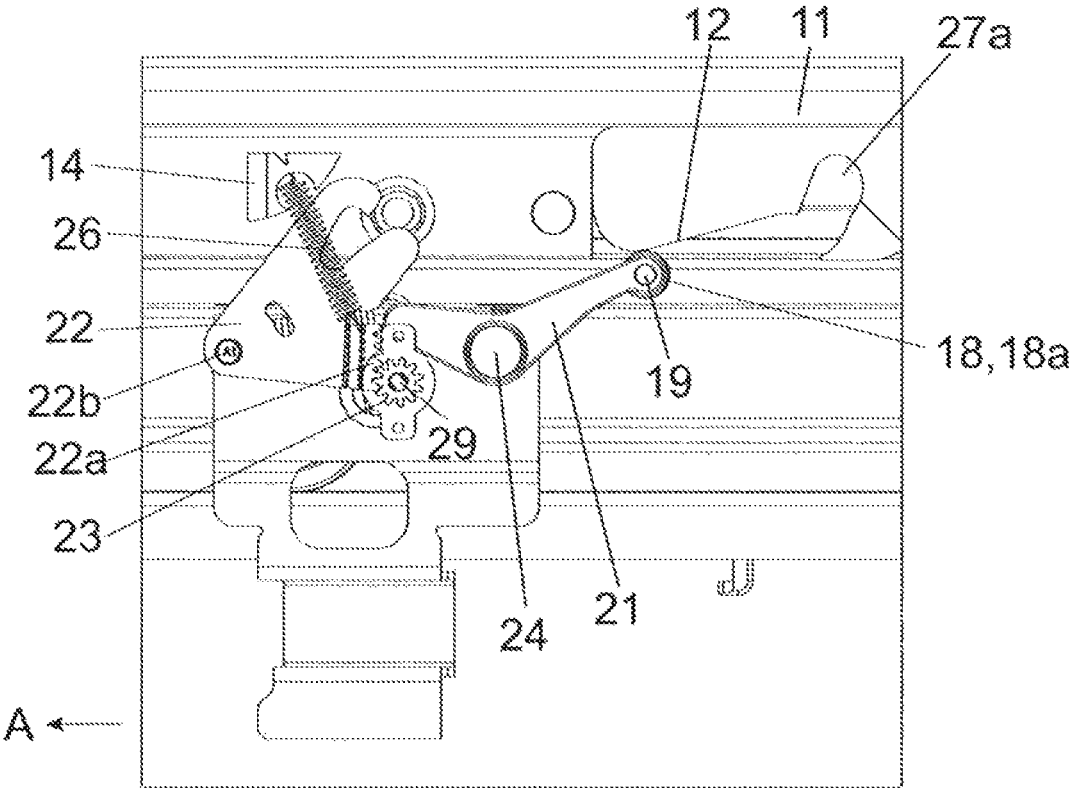

FIG. 8*a* shows the ejection operation of the carrier 14, starting from the retracted position, in the ejection direction (A). The pressure portion 18 in the form of the pressure roller 18*a* is configured to be supported on a recess 27*a* of the bearing body 27, so that the carrier 14 (and therewith the door wings 3*a*, 3*b*) can be ejected by a force of the relaxing force storage member 20 in the ejection direction (A). FIG. 8*b* shows a continued movement of the carrier 14 in the ejection direction (A).

Figure 9A:
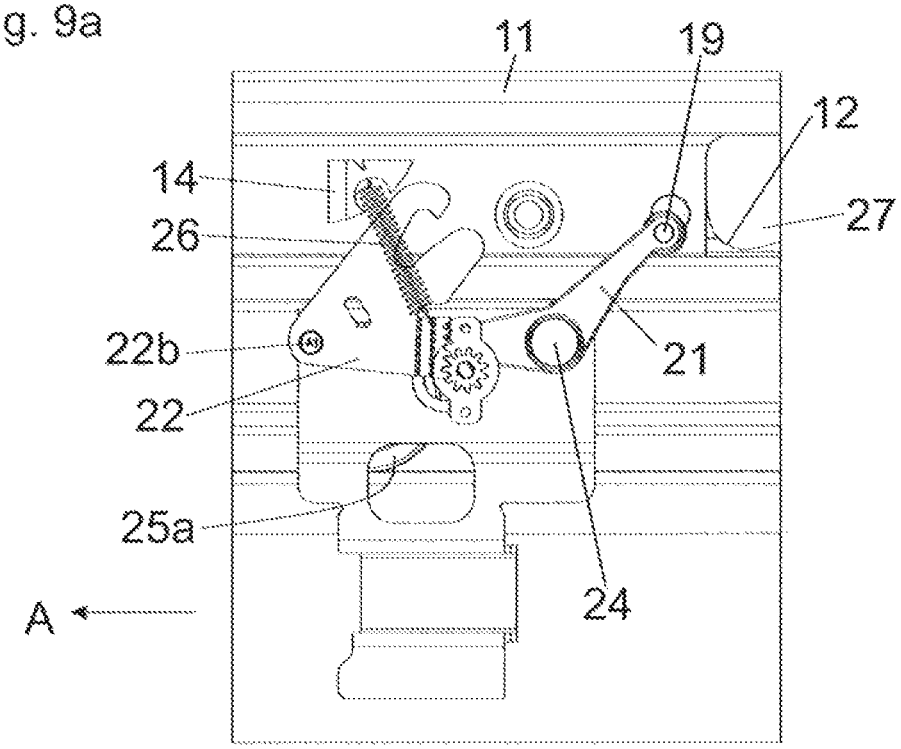
FIG. 9*a*, 9*b* shows a further continued position of the carrier in the ejection direction, and the rear region of the second guide rail in a perspective view.

FIG. 9*a* shows a further continued movement of the carrier 14 in the ejection direction (A). The coupling portion 21 is pivoted about the pivoting axis 24 in the anticlockwise direction by the remaining force of the force storage member 20, and the coupling portion 21 is decoupled from the control curve 12 and the carrier 14 can further be moved in the ejection direction (A) in an uncoupled manner. Upon the next retraction movement of the carrier 14, the coupling portion 21 can be again coupled to the control curve 12, as already shown and described in FIG. 4*b*.

Figure 9B:
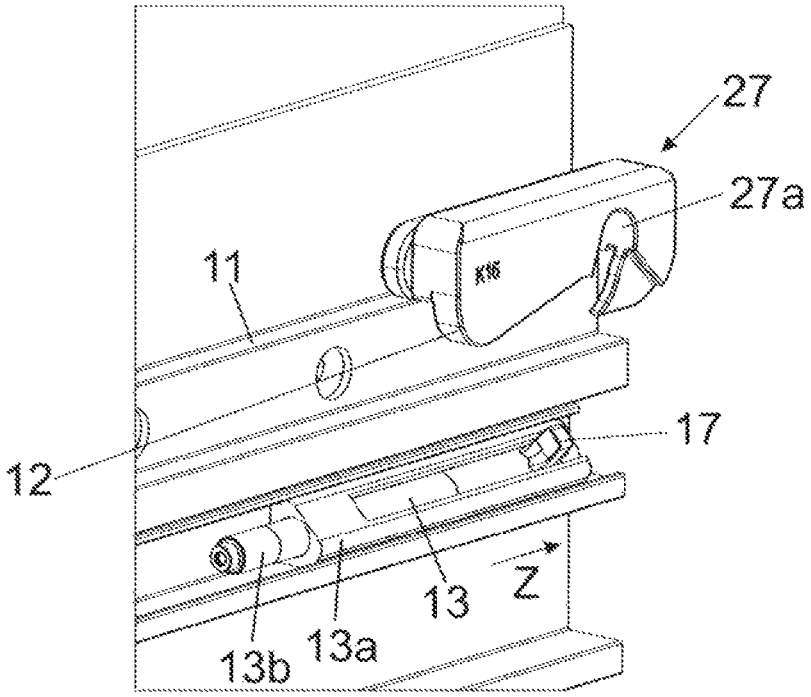

FIG. 9*b* shows the rear end region of the second guide rail 11, in which the bearing portion 27 with the control curve 12 is to be mounted stationarily on the second guide rail 11 or on a side wall 2*a* (FIG. 2) of the furniture carcass 2. Moreover, the damping device 13 for dampening a movement of the carrier 14 in the direction (Z) is visible. In the shown embodiment, the damping device 13 is configured as a piston-cylinder-unit. The abutment portion 17 is connected to a damping cylinder 13*b*, and it is preferably provided that the abutment portion 17 and the damping cylinder 13*b* have a one-piece configuration. The abutment portion 17 can be pressed-in by a movement of the carrier 14 in the direction (Z), whereby the damping cylinder 13*b*, for performing a damping hub, is configured so as to be displaceable relative to the damper housing 13*a* in the direction (Z). The movement of the damping cylinder 13*b* relative to the damper housing 13*a* can be decelerated by the resistance of a, preferably hydraulic, damping medium.

The invention claimed is:

1. A guide system for guiding a movably-supported door wing, the guide system comprising:

a first guide rail having a longitudinal direction for guiding the door wing, a second guide rail for guiding the door wing, the second guide rail extending transversely relative to the longitudinal direction of the first guide rail in a mounted condition, a carrier by which the door wing, in the mounted condition, is to be moved relative to the second guide rail in a direction extending transversely to the longitudinal direction of the first guide rail between an extended position and a retracted position, a drive device having a force storage member, wherein the carrier is configured to be ejected by the drive device from the retracted position at least over a region in a direction of the extended position by a force of the force storage member, wherein the drive device includes a coupling portion and a control curve, wherein the coupling portion and the control curve are configured to be, over a large part of the movement of the carrier between the extended position and the retracted position, decoupled from one another, and the carrier, when the coupling portion couples with the control curve, is to be retracted into the retracted position starting from a position lying immediately before the retracted position.

2. The guide system according to claim 1, wherein either:

the coupling portion is arranged on the carrier or is configured to be entrained with the carrier, and the control curve is arranged on the second guide rail or on a component fixed to a furniture carcass, or the coupling portion is arranged on the second guide rail or on a component fixed to the furniture carcass, and the control curve is arranged on the carrier or is configured to be entrained with the carrier.

3. The guide system according to claim 1, wherein the coupling portion is configured as a two-armed lever.

4. The guide system according to claim 3, wherein the coupling portion has a first lever end and a second lever end, and the first lever end is configured to cooperate with the force storage member and the second lever end is configured to run along the control curve via a pressure portion.

5. The guide system according to claim 4, wherein the pressure portion is a pressure roller.

6. The guide system according to claim 1, further comprising a locking lever by which the coupling portion is to be releasably locked in the retracted position.

7. The guide system according to claim 6, wherein the locking lever and the coupling portion are configured such that locking therebetween is to be released by overpressing the carrier from the retracted position into an overpressing position lying behind the retracted position.

8. The guide system according to claim 6, wherein the locking lever is pre-stressed by a spring element in a direction of a release position in which the coupling portion is released.

9. The guide system according to claim 8, wherein the spring element is configured to operate against a force of a timing element, so that the coupling portion is movable into the release position only after a predetermined time period by a delaying force of the timing element.

10. The guide system according to claim 9, wherein the timing element includes a rotational damper having a pinion cooperating with a tooth arrangement arranged on the locking lever.

11. The guide system according to claim 10, wherein the rotational damper is configured as a fluid damper.

12. The guide system according to claim 1, wherein the force storage member includes a helical spring.

13. The guide system according to claim 12, wherein the helical spring is a tension spring.

14. An arrangement comprising the guide system according to claim 1, the arrangement further comprising:

the door wing.

15. The arrangement according to claim 14, wherein the door wing is a first door wing, the arrangement further comprising a second door wing hingedly connected to the first door wing by a vertically extending axis in the mounted condition.

16. An item of furniture comprising the arrangement according to claim 14.

17. The item of furniture according to claim 16, wherein the door wing is a first door wing, the item of furniture further comprising a furniture carcass and a second door wing, the first door wing and the second door wing being movably supported relative to the furniture carcass, and the first door wing and the second door wing being hingedly connected to one another by a vertically extending pivoting axis in the mounted position, wherein the first door wing and the second door wing are movable by the guide system between a first position, in which the first door wing and the second door wing are aligned substantially parallel to one another, and a second position, in which the first door wing and the second door wing are aligned substantially coplanar to one another.

* * * * *